US011692469B2

(12) United States Patent
He

(10) Patent No.: US 11,692,469 B2
(45) Date of Patent: Jul. 4, 2023

(54) CYLINDER HEAD COVER INTEGRATED WITH ACTIVE OIL MIST SEPARATOR

(71) Applicants: Mahle International GmbH, Stuttgart (DE); MAHLE Automotive Technologies (China) Co., Ltd, Shanghai (CN)

(72) Inventor: Xialong He, Shanghai (CN)

(73) Assignees: Mahle International GmbH; Mahle Automotive Technologies (China) Co., Ltd.

( * ) Notice: Subject to any disclaimer, the term of this patent is extended or adjusted under 35 U.S.C. 154(b) by 0 days.

(21) Appl. No.: 17/541,239

(22) Filed: Dec. 2, 2021

(65) Prior Publication Data

US 2022/0178283 A1 Jun. 9, 2022

(30) Foreign Application Priority Data

Dec. 3, 2020 (CN) ..... 202022885326.0

(51) Int. Cl.
*F01M 13/04* (2006.01)
*F02F 7/00* (2006.01)

(52) U.S. Cl.
CPC ..... *F01M 13/0416* (2013.01); *F02F 7/006* (2013.01); *F02F 7/0068* (2013.01); *F01M 2013/0461* (2013.01)

(58) Field of Classification Search
CPC ..... F01M 13/0416; F01M 2013/0461; F02F 7/006; F02F 7/0068
See application file for complete search history.

(56) References Cited

U.S. PATENT DOCUMENTS 7,644,706 B1 * 1/2010 Yoshida ..... F01M 13/0011 123/574
8,887,705 B2 * 11/2014 Aquino ..... F01M 13/0416 123/572
2016/0194988 A1 * 7/2016 Lawrence ..... F02M 25/06 123/573

* cited by examiner

*Primary Examiner* — Syed O Hasan
(74) *Attorney, Agent, or Firm* — Fishman Stewart PLLC

(57) ABSTRACT

A cylinder head cover integrated with an active oil mist separator may include a cylinder head cover body, a booster, and an oil mist separator. The cylinder head cover body may be provided with an exhaust passage and a separation passage. The booster may be mounted outside the cylinder head cover body. The booster may have a booster intake port and a booster exhaust port. The booster intake port may be connected with the exhaust passage. The booster exhaust port may be connected with the separation passage. The oil mist separator may be mounted in the separation passage and the oil mist separator may be located on a downstream side of the booster.

16 Claims, 10 Drawing Sheets

CYLINDER HEAD COVER INTEGRATED WITH ACTIVE OIL MIST SEPARATOR

TECHNICAL FIELD

The present application relates to the field of engines, in particular to a cylinder head cover integrated with an active oil mist separator.

BACKGROUND ART

An active oil mist separator of the prior art is externally mounted on an engine. An active oil mist separator having such a structure occupies a large space and needs to meet rigorous spatial layout requirements. In addition, pipeline freezing may happen in a cold environment.

SUMMARY OF THE APPLICATION

The present application is intended to provide a cylinder head cover integrated with an active oil mist separator so that the cylinder head cover occupies a small space. The "cylinder cover" in the present context is a cylinder head cover which is usually mounted on the engine.

An "engine" in the present context is an internal combustion engine with a crankcase, with an engine block containing several cylinders and with a cylinder head which is closed with the cylinder cover.

The present application provides a cylinder head cover integrated with an active oil mist separator, and the cylinder head cover integrated with an active oil mist separator comprises:

a cylinder head cover body, the cylinder head cover body being provided with an exhaust passage and a separation passage, a booster, the booster being mounted outside the cylinder head cover body, the booster having a booster intake port and a booster exhaust port, the booster intake port being connected with the exhaust passage, and the booster exhaust port being connected with the separation passage, and an oil mist separator, the oil mist separator being mounted in the separation passage and the oil mist separator being located on the downstream side of the booster.

The booster can be designed as a compressor.

Preferably, the oil mist separator comprises an oil mist separator core and an oil mist separator housing, the oil mist separator housing at least partially surrounds the oil mist separator core, the oil mist separator housing is connected with the oil mist separator core, the oil mist separator core communicates with the separation passage, the oil mist separator core is provided with pores, and air passing through the pores can impact on the oil mist separator housing to separate oil mist from air.

Preferably, the oil mist separator core is connected with the separation passage in an interference fit mode.

Preferably, the oil mist separator core is provided with a plurality of first protruding portions, and the first protruding portions radially protrude outwards from the outer wall surface of the oil mist separator core.

Preferably, the oil mist separator core is provided with a second protruding portion, the second protruding portion axially protrudes outwards from the bottom of the oil mist separator core, and the second protruding portion is located between the bottom of the oil mist separator core and the bottom of the oil mist separator housing.

Preferably, the cylinder head cover integrated with an active oil mist separator further comprises a pressure regulating valve mounted on the cylinder head cover body, the pressure regulating valve communicates with the separation passage, and the pressure regulating valve is located on the downstream side of the oil mist separator.

Preferably, the exhaust passage extends in the length direction of the cylinder head cover body and the booster is disposed on one end of the cylinder head cover body in the length direction.

Preferably, the cylinder head cover integrated with an active oil mist separator further comprises an oil return valve and the oil return valve is located below the oil mist separator.

Preferably, the cylinder head cover body is mounted with a support block, the support block has threaded holes, the booster is provided with mounting holes, the mounting holes and the threaded holes overlap, the booster is fixedly connected with the cylinder head cover body 1 by threading bolts through the mounting holes and screwing the bolts in the support block, and a sealing ring is disposed between the cylinder head cover body and the booster.

Preferably, the cylinder head cover integrated with an active oil mist separator further comprises a mounting rack, the booster is fixedly connected with the mounting rack, and the mounting rack is connected with the cylinder head cover body or is used to mount the engine of the cylinder head cover body.

Preferably can be provided that the aforementioned booster is designed as a side channel booster or more preferably as a side channel compressor.

By adopting the above-mentioned technical solution to integrate the oil mist separator into the cylinder head cover body, the cylinder head cover occupies a small space.

DESCRIPTION OF REFERENCE NUMERALS IN THE ATTACHED DRAWINGS

Figure 1:
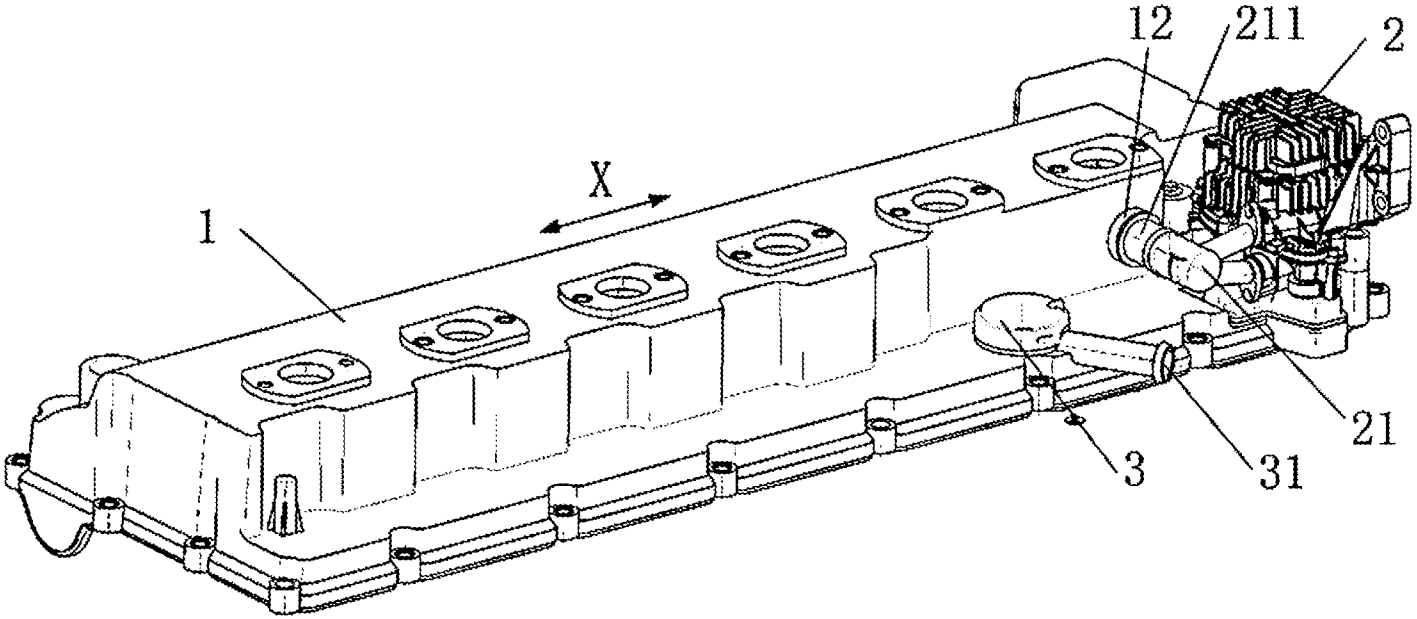
FIG. 1 shows the structure of the cylinder head cover integrated with an active oil mist separator according to a first embodiment of the present application.
Figure 2:
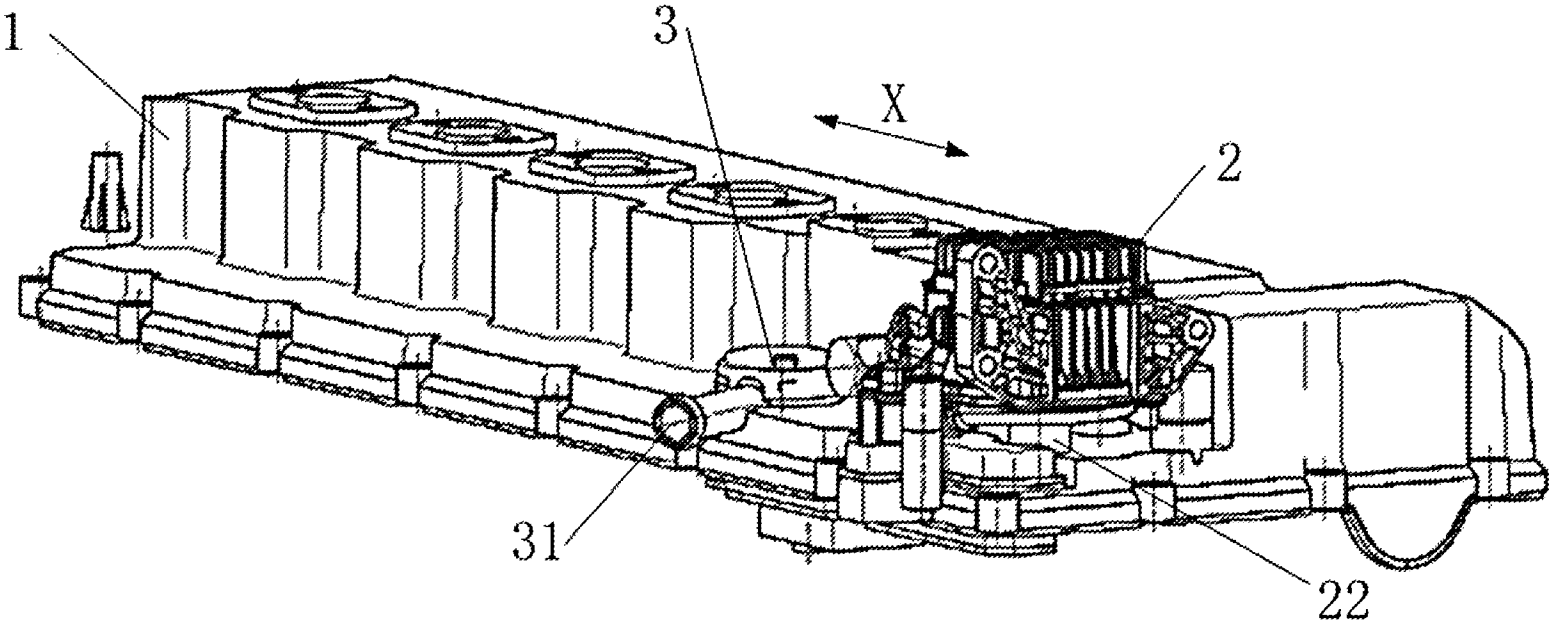
FIG. 2 shows the structure of the cylinder head cover integrated with an active oil mist separator according to a first embodiment of the present application, viewed from another angle.
Figure 3:
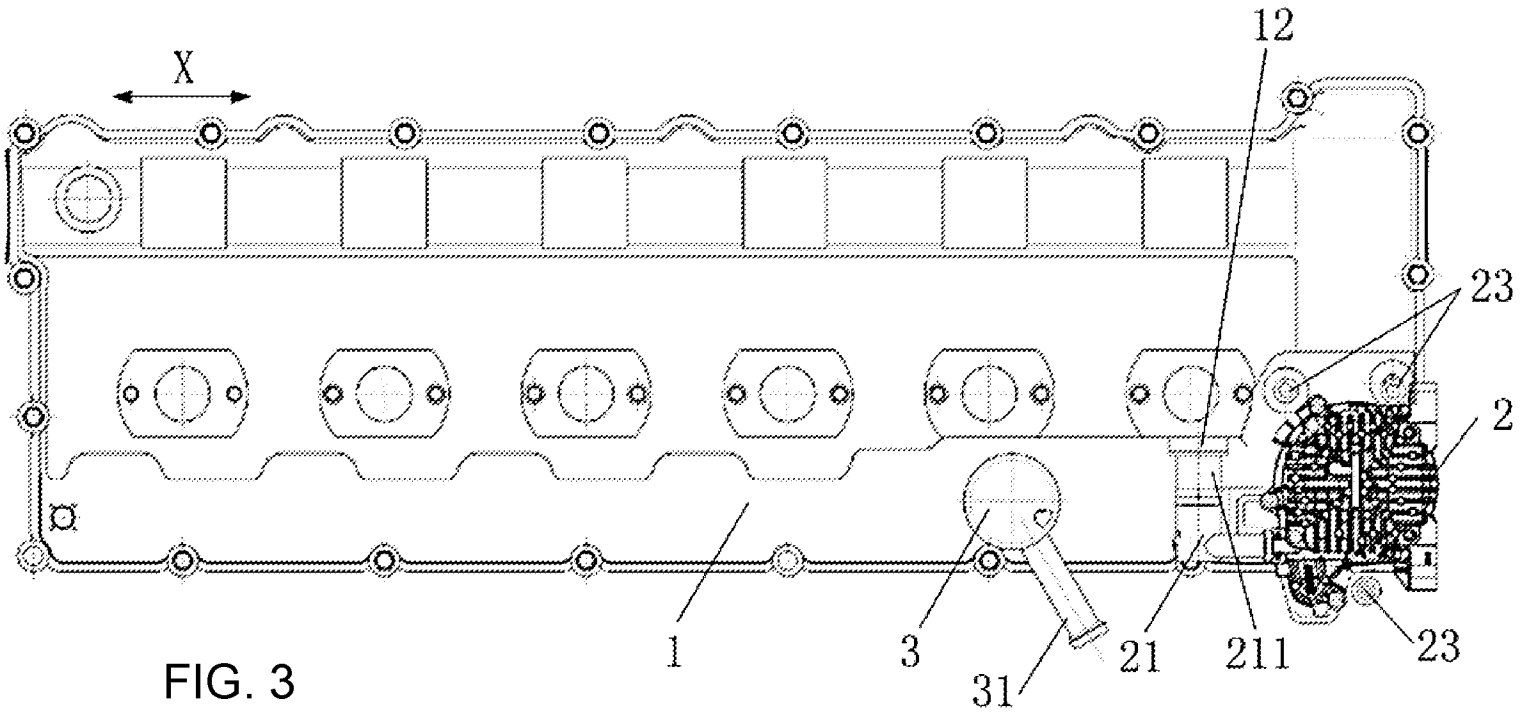
FIG. 3 is a top view of the cylinder head cover integrated with an active oil mist separator according to a first embodiment of the present application.

1. cylinder head cover body, 11. support block, 12. cylinder head cover exhaust port, 13. baseplate, 14. accommodation portion, 17. separation passage
2. booster, 21. booster intake port, 22. booster exhaust port, 23. mounting hole
3. pressure regulating valve, 31. pressure regulating valve exhaust port
4. bolt
5. sealing ring
6. oil mist separator, 61. oil mist separator core, 611. platform, 612. slot, 613. pore, 614. first protruding portion, 615. second protruding portion, 616. fin, 62. oil mist separator housing, 621. fastener
7. oil return valve
8. mounting rack
X. length direction

DETAILED DESCRIPTION OF THE UTILITY MODEL

To make clearer the above-mentioned object, features and advantages of the present application, specific implementation modes of the present application are described in detail in combination with the drawings. The present application can be implemented through embodiments other than those described here. Without departing from the spirit of the present application, those skilled in the art can make corresponding improvements, variations and replacements. Accordingly, the present application is not restricted by the specific embodiments disclosed here. The scope of protection of the present application is subject to the claims.

First Embodiment

In the description below, the inside of the cylinder head cover body 1 refers to the cylinder head cover body 1 and the engine, in particular to one side communicating with the crankcase of the engine, and the outside of the cylinder head cover body 1 refers to another side where the cylinder head cover communicates with the external environment.

As shown in FIGS. 1 to 8, the cylinder head cover integrated with an active oil mist separator in the present application comprises a cylinder head cover body 1, a booster 2, a pressure regulating valve 3, an oil mist separator 6 and an oil return valve 7. The booster 2 and the pressure regulating valve 3 are mounted on the cylinder head cover body 1, and the oil mist separator 6 is integrated into the inside of the cylinder head cover body 1.

The booster 2 has a booster intake port 21 and a booster exhaust port 22, and the booster 2 can draw air into the booster 2 from the booster intake port 21 and discharge boosted air out of the booster exhaust port 22. The booster 2 is mounted outside the cylinder head cover body 1. For example, the booster 2 is mounted on the upper surface of the cylinder head cover body 1. The booster 2 may be an air compressor.

Specifically, as shown in FIGS. 1 to 6, the booster 2 is fixedly connected with the cylinder head cover body 1 by way of bolts, and the booster 2 may be provided with three mounting holes 23 connected with the cylinder head cover body 1. The cylinder head cover body 1 is—for each screw connection—mounted with a support block 11 and the support block 11 has threaded holes 16. The support block 11 can be a sleeve and/or can be inserted or pressed or welded or cast into a receiving opening 18 of the cylinder head cover body 1. The support bock 11 is expediently made of metal, while the cylinder head cover body 1 is preferably made of plastic. The threaded holes 16 of the support block 11 overlap the mounting holes 23 of the booster 2, and bolts 4 are threaded through the mounting holes 23 and screwed into the threaded holes 16 of the support block 11 so that the booster 2 is fixedly connected with the cylinder head cover body 1. The screw or bolt 4 can be designed as a collar bolt, which has a collar 41 with which the bolt 4 is supported on the support block 11. A head 42 of the block 4 can be supported on the booster 2. Further, at least one sealing ring 5 may be disposed between the cylinder head cover body 1 and the booster 2 to keep the cylinder head cover body 1 in a sealed state. The sealing ring 5 can be inserted in a receiving groove 15, which can be formed in the cylinder head cover body 1, for example. It is expedient to provide one sealing ring 5 for each screw connection. The support block 11 can be positioned on or in the cylinder head cover body 1 in such a way that a gap 19 is formed between the cylinder head cover body 1 and the booster 2, which is bridged or closed by the respective sealing ring 5. For this purpose, the sealing ring 5 can protrude beyond the receiving groove 15.

The cylinder head cover body 1 is provided with an exhaust passage, the exhaust passage may extend in the length direction X of the cylinder head cover body 1, and the exhaust passage is provided with a cylinder head cover exhaust port 12 communicating with the outside of the cylinder head cover body 1. When the cylinder head cover integrated with an active oil mist separator is mounted on the cylinder head of an engine, the exhaust passage communicates with the crankcase of the engine, and crankcase blow-by air can be discharged out of the cylinder head cover body 1 through the cylinder head cover exhaust port 12.

The booster intake port 21 and the cylinder head cover exhaust port 12 may be connected through a rubber hose 211, and in addition, the rubber hose 211 may be fixed by use of a clamp.

As shown in FIGS. 1 to 4, the booster 2 may be disposed on one end of the cylinder head cover body 1 in the length direction X so that crankcase blow-by air can unidirectionally flow along the exhaust passage into the booster 2.

Figure 4:
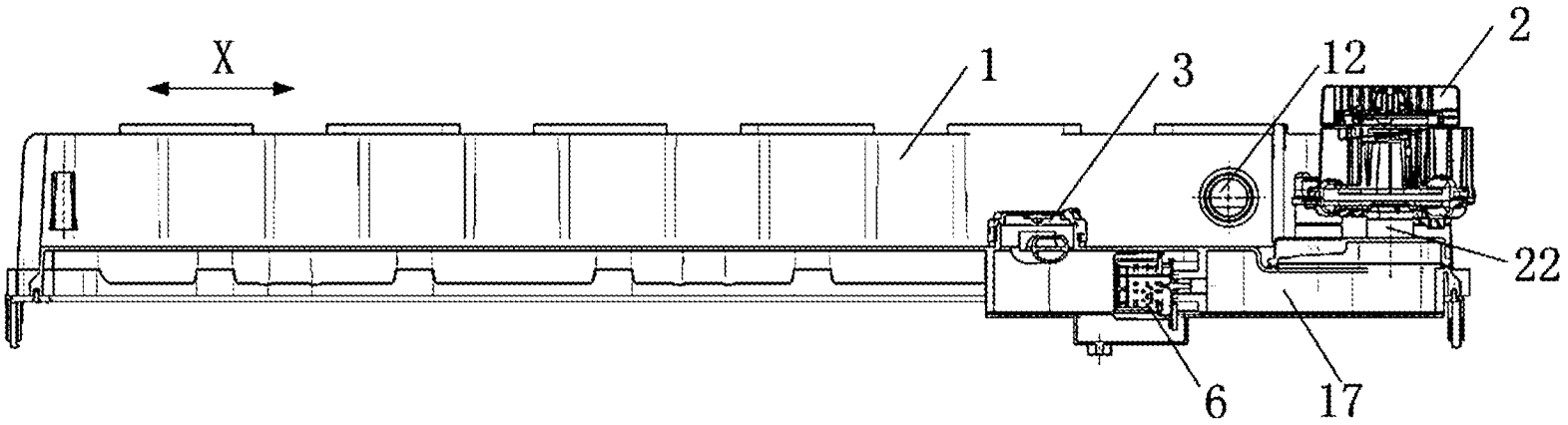
FIG. 4 is a cutaway view of the cylinder head cover integrated with an active oil mist separator according to a first embodiment of the present application.
Figure 5:
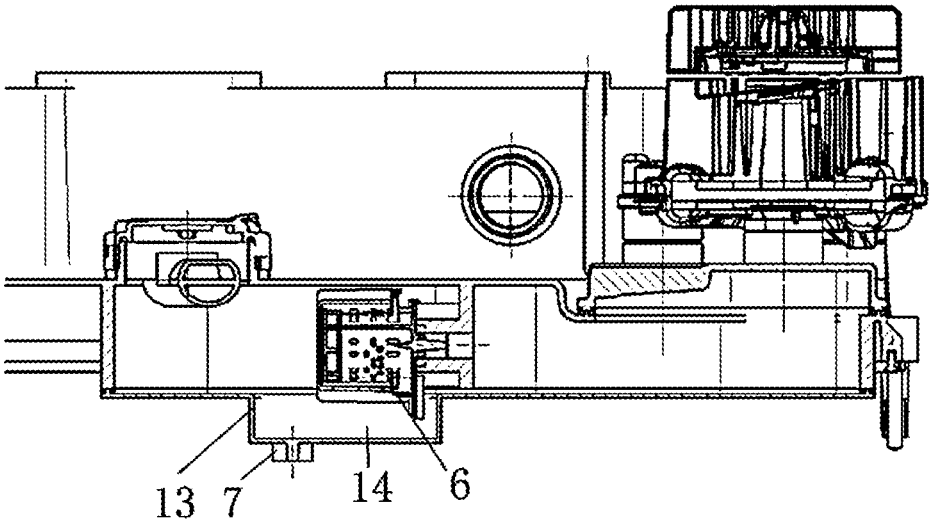
FIG. 5 is an enlarged partial view of the cylinder head cover in FIG. 4.
Figure 6:
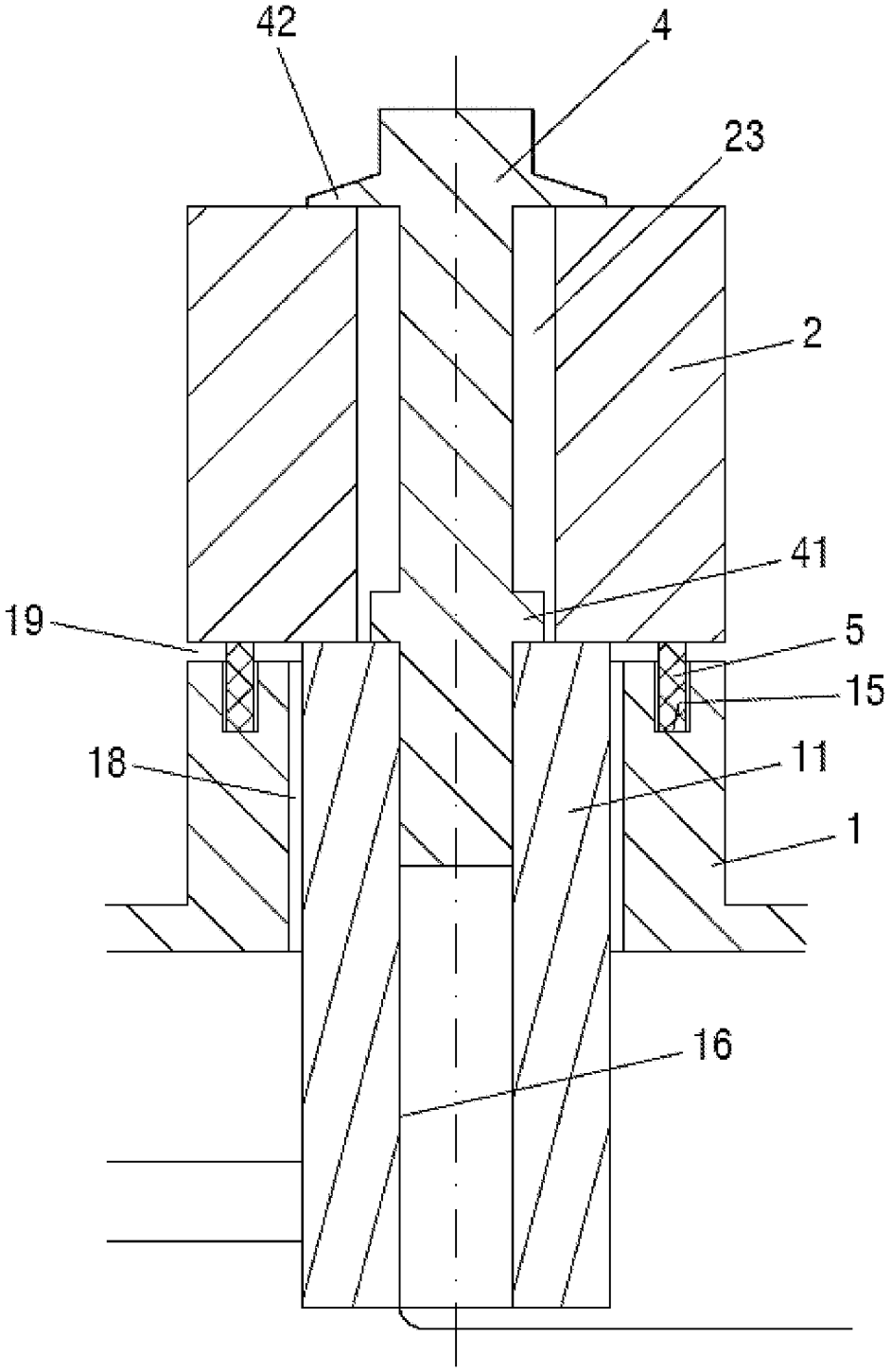
FIG. 6 shows the connection between the cylinder head cover boy and the booster of the cylinder head cover integrated with an active oil mist separator according to a first embodiment of the present application.

As shown in FIGS. 4 and 5, a separation channel 17 is disposed inside the cylinder head cover body 1 and the separation passage 17 may extend in the length direction X of the cylinder head cover body 1. The baseplate 13 is connected with the cylinder head cover body 1 so that the separation passage 17 is sealed, and the booster exhaust port 22 communicates with the separation passage 17 so that crankcase blow-by air boosted by the booster 2 can be injected into the separation passage 17.

The oil mist separator 6 is mounted in the separation passage 17, the oil mist separator 6 is located on the downstream side of the booster 2, the separation passage 17 comprises a cylindrical passage, the oil mist separator 6 is cylindrical as a whole, and the oil mist separator 6 may be mounted in the separation passage 17 in an interference fit mode. An O-ring may be disposed between the oil mist separator 6 and the inner wall of the separation passage 17 to keep them sealed.

The baseplate 13 may be recessed downwards to form an accommodation portion 14, the accommodation portion 14 is located below the oil mist separator 6, and the accommodation portion 14 is configured to accommodate engine oil separated by the oil mist separator 6. An oil return valve 7 is mounted at the accommodation portion 14, the oil return valve 7 is located below the oil mist separator 6, and engine oil separated by the oil mist separator 6 drips off the oil return valve 7 so that condensed engine oil can return to the oil sump again to participate in lubrication of the motion mechanism.

Figure 7:
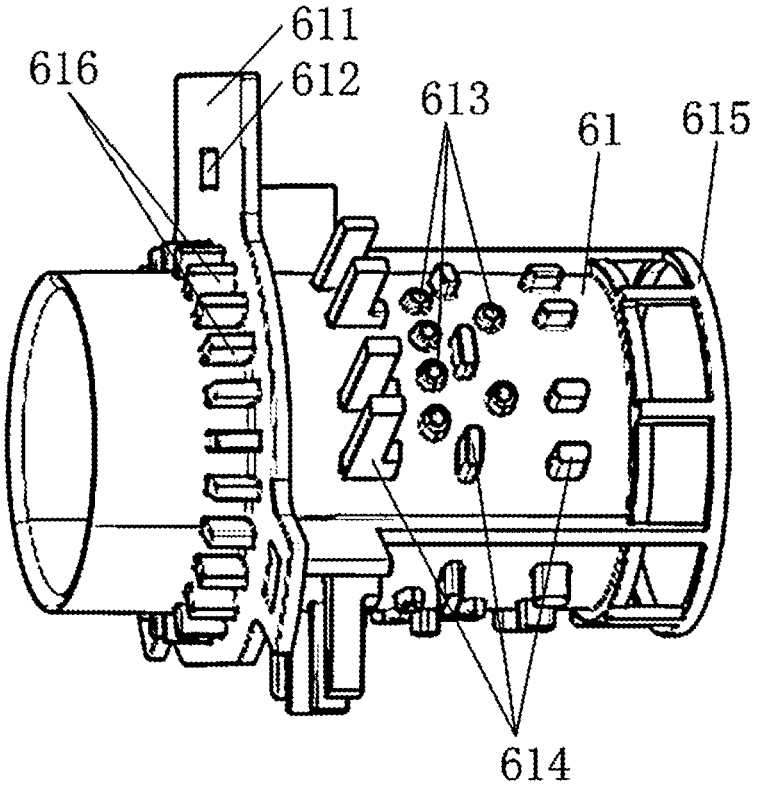
FIG. 7 shows the structure of the oil mist separator core of the cylinder head cover integrated with an active oil mist separator according to a first embodiment of the present application.
Figure 8:
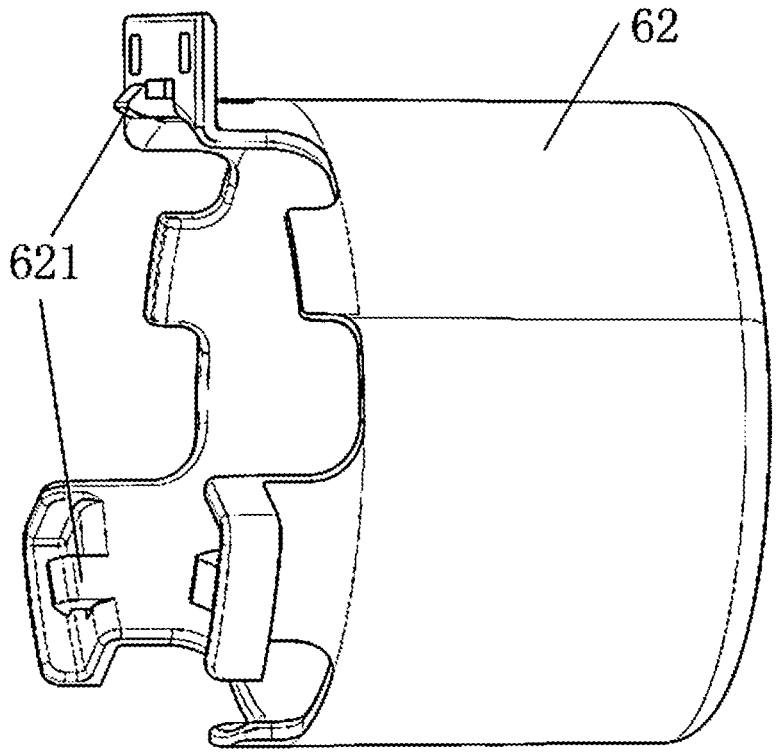
FIG. 8 shows the structure of the oil mist separator housing of the cylinder head cover integrated with an active oil mist separator according to a first embodiment of the present application.

As shown in FIGS. 5, 7 and 8, the oil mist separator 6 comprises an oil mist separator core 61 and an oil mist separator housing 62, the oil mist separator housing 62 is connected with the oil mist separator core 61, and the oil mist separator housing 62 at least partially surrounds the oil mist separator core 61.

The oil mist separator core 61 is a cylinder with a closed end, a platform 611 extending outwards in the radial direction of the oil mist separator core 61 is disposed on the side wall of the oil mist separator core 61, and the platform 611 is provided with slots 612.

The oil mist separator housing 62 is a cylinder with a closed end, and the oil mist separator housing 62 is provided with fasteners 621. The fasteners 621 are located at the edge of the opening of the oil mist separator housing 62. By inserting the fasteners 621 into the slots 612, the oil mist separator core 61 is placed into the oil mist separator housing 62, and the oil mist separator core and the oil mist separator housing are fixedly connected.

The oil mist separator core 61 is provided with a plurality of pores 613 on the side wall. The oil mist separator core 61 may be provided with a plurality of first protruding portions 614 on the side wall, the first protruding portions 614 radially protrude outwards from the outer wall surface of the oil mist separator core 61, the first protruding portions 614 are configured to support the oil mist separator housing 62 and maintain the distance between the side wall of the oil mist separator core 61 and the oil mist separator housing 62.

A second protruding portion 615 is provided on one end of the oil mist separator core 61, axially away from the opening, and the second protruding portion 615 may axially extend outwards from the bottom of the oil mist separator core 61. The second protruding portion 615 may be disposed around the circumference of the oil mist separator core 61, and the second protruding portion 615 may have a hollowed framework. The second protruding portion is located between the bottom of the oil mist separator core and the bottom of the oil mist separator housing, and the second protruding portion 615 may be configured to maintain the distance between the bottom surface of the oil mist separator core 61 and the oil mist separator housing 62.

A plurality of fins 616 are disposed on one axial side of the platform 611, the plurality of fins 616 are disposed around the circumference of the oil mist separator core 61, and the fins 616 and the inner wall of the separation passage 17 may be connected in an interference fit mode.

Blow-by air entering the oil mist separator 61 impacts on the oil mist separator housing 62 after passing through the pores 613 so that engine oil is separated from air. Separated air flows to the pressure regulating valve 3, and the pressure regulating valve 3 may be connected to the air induction system of the engine so that the separated air can participate in a combustion reaction again. Separated engine oil will drip off the oil return valve 7 so that engine oil can return to the oil sump again to participate in lubrication of the motion mechanism.

The oil mist separator 6 communicates with the crankcase through the exhaust passage and the separation passage 17 in the cylinder head cover body 1, and the oil mist separator 6 can separate engine oil from crankcase blow-by air.

As shown in FIGS. 1 to 4, the pressure regulating valve 3 is mounted outside the cylinder head cover body 1. For example, the pressure regulating valve 3 may be mounted on the upper surface of the cylinder head cover body 1. The pressure regulating valve 3 communicates with the separation passage 17 and is located on the downstream side of the oil mist separator 6, and air separated by the oil mist separator 6 may flow to the pressure regulating valve 3. The pressure regulating valve 3 is provided with a pressure regulating valve exhaust port 31, and the pressure regulating valve exhaust port 31 may be connected to the air induction system of the engine through a pipeline so that crankcase blow-by air from which engine oil is separated can return to the engine again to participate in a combustion reaction.

Oil mist separators of the prior art have a large housing, are mounted outside the cylinder head covers, and occupy a large space. In the present application, the oil mist separator 6 is integrated into the cylinder head cover body 1 so that the cylinder head cover occupies a small space as a whole. In addition, no pipeline connection is required between the oil mist separator 6 and the cylinder head cover body 1 in the present application, thus avoiding a potential risk of pipeline freezing.

Second Embodiment

The overall structure of the cylinder head cover integrated with an active oil mist separator in the second embodiment of the present application is similar to the overall structure of the cylinder head cover integrated with an active oil mist separator in the first embodiment of the present application, and in the second embodiment, the components which are the same as or similar to those in the first embodiment are denoted by the same reference numerals and will not be described here again.

Figure 9:
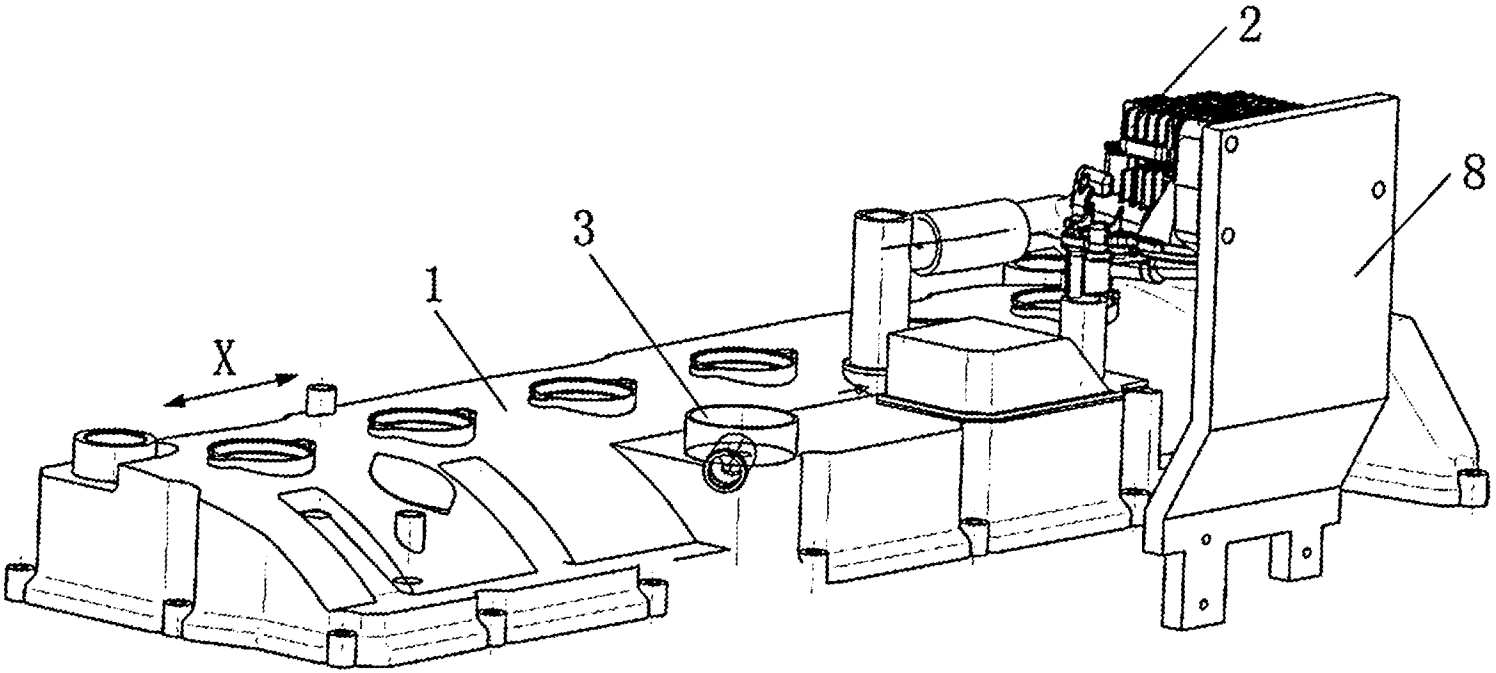
FIG. 9 shows the structure of the cylinder head cover integrated with an active oil mist separator according to a second embodiment of the present application.
Figure 10:
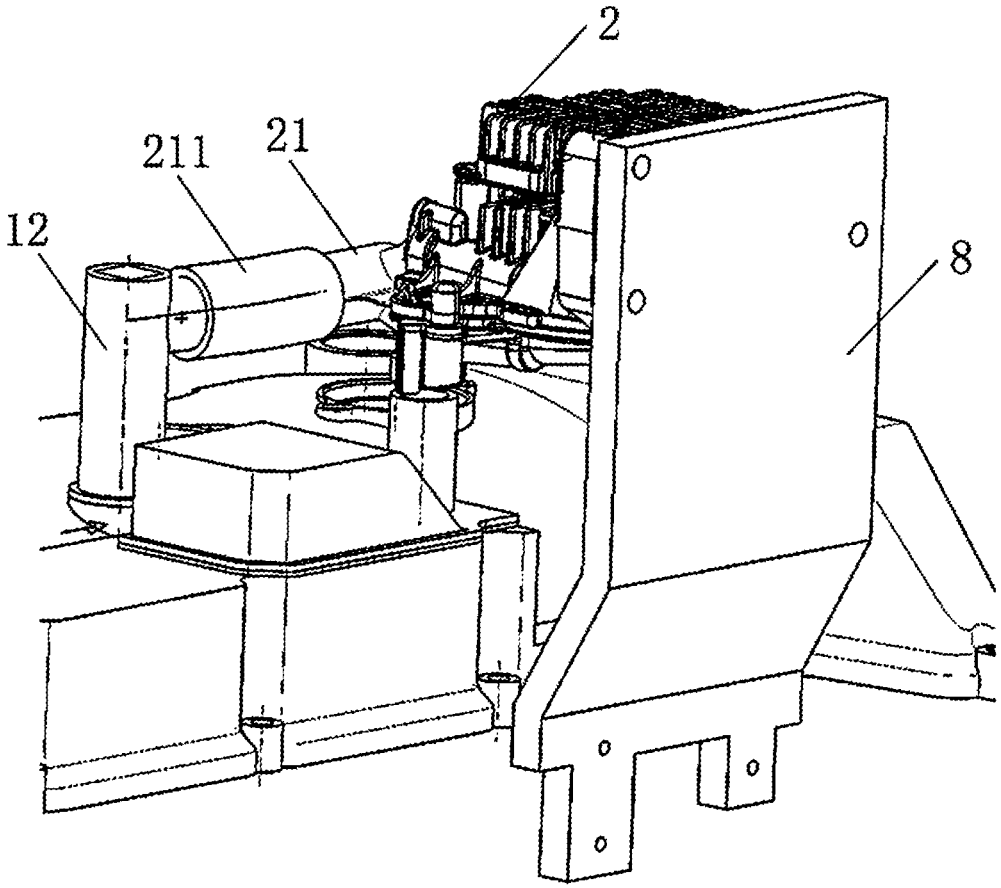
FIG. 10 is an enlarged partial view of the cylinder head cover in FIG. 9.

As shown in FIGS. 9 and 10, the cylinder head cover integrated with an active oil mist separator in the present application comprises a cylinder head cover body 1, a booster 2, a pressure regulating valve 3, an oil mist separator 6, an oil return valve and a mounting rack 8.

The pressure regulating valve 3 is mounted on the cylinder head cover body 1, and the oil mist separator 6 is integrated into the inside of the cylinder head cover body 1. The booster 2 may be mounted on the cylinder head cover body 1 or an engine by way of the mounting rack 8. The booster 2 is fixedly connected with the mounting rack 8, and the mounting rack 8 may be connected with the cylinder head cover body 1 or used to mount the engine of the cylinder head cover body 1.

It may be understood that when the booster 2 is mounted on the engine by way of the mounting rack 8, instead of being directly mechanically mounted on the cylinder head cover body 1, no support block needs to be provided for the cylinder head cover body 1 or no sealing ring needs to be used at the bolts connecting the booster to seal the cylinder head cover body just as in the first embodiment.

However, when the booster 2 is mounted on the engine by way of the mounting rack 8, instead of being directly mechanically mounted on the cylinder head cover body 1, the booster 2 may still be located, for example, above the cylinder head cover body 1 to be connected with the exhaust passage of the cylinder head cover body 1 and the pressure regulating valve.

Although the above-mentioned embodiments are used to describe the present application in detail, it is obvious to those skilled in the art that the present application is not limited to the described embodiments. Without departing from the main idea and scope determined by the claims of the present application, modifications can be made to the present application and can be implemented as altered embodiments. Therefore, the description in the document is used for the exemplary description purpose and does not have any restrictive meaning to the present application.

The invention claimed is:

1. A cylinder head cover integrated with an active oil mist separator, the cylinder head cover comprising: a cylinder head cover body provided with an exhaust passage and a separation passage; a booster mounted outside the cylinder head cover body, the booster having a booster intake port and a booster exhaust port, the booster intake port being connected with the exhaust passage, and the booster exhaust port being connected with the separation passage; and an oil mist separator mounted in the separation passage and the oil mist separator being located on a downstream side of the booster; wherein the oil mist separator comprises an oil mist separator core and an oil mist separator housing, the oil mist separator housing at least partially surrounds the oil mist separator core, the oil mist separator housing is connected with the oil mist separator core, the oil mist separator core communicates with the separation passage, the oil mist separator core is provided with pores, and air passing through the pores can impact on the oil mist separator housing to separate oil mist from air; and the oil mist separator core is connected with the separation passage in an interference fit mode.

2. A cylinder head cover integrated with an active oil mist separator, the cylinder head cover comprising: a cylinder head cover body provided with an exhaust passage and a separation passage; a booster mounted outside the cylinder head cover body, the booster having a booster intake port and a booster exhaust port, the booster intake port being connected with the exhaust passage, and the booster exhaust port being connected with the separation passage; and an oil mist separator mounted in the separation passage and the oil mist separator being located on a downstream side of the booster; wherein the oil mist separator comprises an oil mist separator core and an oil mist separator housing, the oil mist separator housing at least partially surrounds the oil mist separator core, the oil mist separator housing is connected with the oil mist separator core, the oil mist separator core communicates with the separation passage, the oil mist separator core is provided with pores, and air passing through the pores can impact on the oil mist separator housing to separate oil mist from air; wherein the oil mist separator core is provided with a plurality of first protruding portions, and the first protruding portions radially protrude outwards from an outer wall surface of the oil mist separator core.

3. The cylinder head cover according to claim 2, wherein the oil mist separator core is provided with a second protruding portion, the second protruding portion axially protrudes outwards from a bottom of the oil mist separator core, and the second protruding portion is located between the bottom of the oil mist separator core and the bottom of the oil mist separator housing.

4. The cylinder head cover according to claim 1, wherein the cylinder head cover further comprises a pressure regulating valve mounted on the cylinder head cover body, the pressure regulating valve communicates with the separation passage, and the pressure regulating valve is located on the downstream side of the oil mist separator.

5. The cylinder head cover according to claim 1, wherein the exhaust passage extends in a length direction of the cylinder head cover body and the booster is disposed on one end of the cylinder head cover body in the length direction.

6. The cylinder head cover according to claim 1, wherein the cylinder head cover further comprises an oil return valve and the oil return valve is located below the oil mist separator.

7. The cylinder head cover according to claim 1, wherein the cylinder head cover body is mounted with a support block, the support block has threaded holes, the booster is provided with mounting holes, the mounting holes and the threaded holes overlap, the booster is fixedly connected with the cylinder head cover body by threading bolts through the mounting holes and screwing the bolts in the support block, and a sealing ring is disposed between the cylinder head cover body and the booster.

8. The cylinder head cover according to claim 1, wherein the cylinder head cover further comprises a mounting rack, the booster is fixedly connected with the mounting rack, and the mounting rack is connected with the cylinder head cover body or used to mount an engine of the cylinder head cover body.

9. The cylinder head cover according to claim 1, wherein the booster is designed as a side channel booster.

10. A cylinder head cover, comprising: a cylinder head cover body provided with an exhaust passage and a separation passage; a booster mounted outside the cylinder head cover body, the booster having a booster intake port and a booster exhaust port, the booster intake port being connected with the exhaust passage, and the booster exhaust port being connected with the separation passage; an oil mist separator mounted in the separation passage and the oil mist separator being located on a downstream side of the booster; and a pressure regulating valve mounted on the cylinder head cover body, the pressure regulating valve communicates with the separation passage, and the pressure regulating valve is located on the downstream side of the oil mist separator wherein the oil mist separator comprises an oil mist separator core and an oil mist separator housing, the oil mist separator housing at least partially surrounds the oil mist separator core, the oil mist separator housing is connected with the oil mist separator core, the oil mist separator core communicates with the separation passage, the oil mist separator core is provided with pores, and air passing through the pores can impact on the oil mist separator housing to separate oil mist from air; and the oil mist separator core is connected with the separation passage in an interference fit mode.

11. The cylinder head cover according to claim 10, wherein the oil mist separator core is provided with a plurality of first protruding portions, and the first protruding portions radially protrude outwards from an outer wall surface of the oil mist separator core.

12. The cylinder head cover according to claim 10, wherein the oil mist separator core is provided with a second protruding portion, the second protruding portion axially protrudes outwards from a bottom of the oil mist separator core, and the second protruding portion is located between the bottom of the oil mist separator core and the bottom of the oil mist separator housing.

13. The cylinder head cover according to claim 10, wherein the exhaust passage extends in a length direction of the cylinder head cover body and the booster is disposed on one end of the cylinder head cover body in the length direction.

14. The cylinder head cover according to claim 10, wherein the cylinder head cover further comprises an oil return valve and the oil return valve is located below the oil mist separator.

15. The cylinder head cover according to claim 10, wherein the cylinder head cover body is mounted with a support block, the support block has threaded holes, the booster is provided with mounting holes, the mounting holes and the threaded holes overlap, the booster is fixedly connected with the cylinder head cover body by threading bolts through the mounting holes and screwing the bolts in the support block, and a sealing ring is disposed between the cylinder head cover body and the booster.

16. The cylinder head cover according to claim 10, wherein the cylinder head cover further comprises a mounting rack, the booster is fixedly connected with the mounting rack, and the mounting rack is connected with the cylinder head cover body or used to mount an engine of the cylinder head cover body.

* * * * *